US007219517B2

(12) United States Patent
Maeng

(10) Patent No.: US 7,219,517 B2
(45) Date of Patent: May 22, 2007

(54) WASHING MACHINE

(75) Inventor: Chang-Jae Maeng, Yongin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 588 days.

(21) Appl. No.: 10/314,171

(22) Filed: Dec. 9, 2002

(65) Prior Publication Data

US 2004/0000177 A1 Jan. 1, 2004

(30) Foreign Application Priority Data

Jun. 29, 2002 (KR) ..... 2002-37602
Jul. 26, 2002 (KR) ..... 2002-44329

(51) Int. Cl.
*D06F 39/02* (2006.01)

(52) U.S. Cl. ..... 68/17 R; 222/651; 222/236

(58) Field of Classification Search ..... 68/17 R; 134/93; 222/651, 231, 236
See application file for complete search history.

(56) References Cited

U.S. PATENT DOCUMENTS 4,862,711 A * 9/1989 Ikeda et al. ..... 68/12.18
4,917,272 A * 4/1990 Ikeda ..... 222/231
5,261,432 A * 11/1993 Sandrin ..... 134/93
6,865,911 B2 * 3/2005 Bolduan et al. ..... 68/17 R

FOREIGN PATENT DOCUMENTS

DE 3403628 A1 * 8/1985
JP 2001-340687 12/2001
JP 2002035477 A * 2/2002

* cited by examiner

*Primary Examiner*—Joseph L. Perrin
(74) *Attorney, Agent, or Firm*—Staas & Halsey LLP

(57) ABSTRACT

A washing machine having a detergent supply device which is easily installed in a cabinet of the washing machine, and is not exposed to the outside of the cabinet. The detergent supply device includes a detergent container and a handle, and is seated in a reception chamber defined at an upper portion of the cabinet. Locking slots are formed on side mounting parts of the handle, and locking projections are provided on opposite sidewalls of the reception chamber, so as to have the locking projections be inserted into the locking slots where the handle is downwardly rotated. A cover is hinged to an upper portion of the reception chamber so as not to expose the detergent supply device to the outside. At least one hook is provided on a front end of the cover, and at least one hook hole is formed on a front portion of the reception chamber to engage with the hook, so as to have the cover openably cover the upper portion of the reception chamber.

23 Claims, 8 Drawing Sheets

WASHING MACHINE

CROSS-REFERENCE TO RELATED APPLICATIONS

This application claims the benefit of Korean Patent Application No. 2002-37602, filed Jun. 29, 2002 and Application No. 2002-44329, filed Jul. 26, 2002 in the Korean Intellectual Property Office, the disclosures of which are incorporated herein by reference.

BACKGROUND OF THE INVENTION

1. Field of the Invention

The present invention relates to washing machines, and more particularly, to a washing machine having a detergent supply device which is easily and removably installed in an upper portion of a cabinet of the washing machine.

2. Description of the Related Art

Generally, washing machines are apparatuses which wash laundry by rotating a cylindrical rotary tub thereof, containing the laundry and wash water. Such washing machines have been typically classified into drum type washing machines and vertical shaft type washing machines. In drum type washing machines, a rotary tub is horizontally set in a cabinet. The rotary tub is rotated around a horizontal axis of the cabinet in alternating directions to repeatedly move laundry upward and allow the laundry to be dropped from a top to a bottom inside the rotary tub, due to gravity, thus washing the laundry. In the vertical shaft type washing machines, a rotary tube having a pulsator is vertically set in a cabinet and is rotated around a vertical axis of the cabinet in alternating directions. Accordingly, laundry inside the rotary tub is washed by forced water currents generated by the pulsator.

FIG. 1 shows a partial perspective view of a conventional vertical shaft type washing machine having a conventional detergent supply device 10 installed to the washing machine. As shown in FIG. 1, the conventional vertical shaft type washing machine includes a cabinet 1 which defines an appearance of the washing machine. A cylindrical washing tub 2 is vertically set in the cabinet 1, and a spin-drying tub 3 is rotatably and concentrically set in the washing tub 2. A pulsator (not shown) is interiorly installed on a bottom of the spin-drying tub 3, and is rotated in alternating directions to generate wash water currents inside the spin-drying tub 3 to wash laundry. The cabinet 1 is open at its top to allow a user to place or remove the laundry from the spin-drying tub 3. A door (not shown) is hinged to the open top of the cabinet 1 to selectively open and close the cabinet 1.

The conventional detergent supply device 10 is installed at a rear position on an upper portion of the cabinet 1 to supply powdered detergent to the washing tub 2. The detergent supply device 10 includes a box-shaped detergent container 11 and a cover 12 which functions to open and close an open top of the detergent container 11. A detergent feeding unit 13 is provided on a lower end of the detergent container 11 to feed the powdered detergent from the detergent container 11 into the washing tub 2.

Two hooks 14 are provided on the lower portions of opposite sidewalls of the detergent container 11 to removably install the detergent supply device 10 to the upper portion of the cabinet 1. A push button 15 is installed at a position above either of the two hooks 14, and functions to push the corresponding hook 14 inward to release the detergent supply device 10 from the cabinet 1.

A reception chamber 4 is defined at a rear position on the upper portion of the cabinet 1 to receive the detergent supply device 10. Hook holes 5 are formed on inside surfaces of corresponding opposite sidewalls of the reception chamber 4 so as to engage with the hooks 14. Since the push button 15 and the two hooks 14 are provided on the lower portion of the detergent container 11, the reception chamber 4 has a depth suitable to receive only the detergent feeding unit 13, which downwardly extends from the lower end of the detergent container 11.

The conventional washing machine having the detergent supply device 10 is difficult to operate, and it takes a long time to lock or release the detergent supply device 10 to or from the reception chamber 4 of the cabinet 1. That is, where a user desires to release the detergent supply device 10 from the reception chamber 4, the user necessarily holds the detergent container 11 with one hand and presses the push button 15 with the other hand. In such a state, the user lifts up the detergent container 11 such that the hook 14 operated in conjunction with the push button 15 disengages from the corresponding hook hole 5 of the reception chamber 4. Next, the user lifts up the detergent container 11 again after pulling the detergent container 11 to a side, which is provided with the push button 15, thus disengaging the other hook 14 from the respective hook hole 5.

To lock the detergent supply device 10 back into the cabinet 1, the detergent container 11 is slightly inclined in a direction to engage the hook 14, provided on a sidewall which is not provided with the push button 15, with the respective hook hole 5 which is provided on the reception chamber 4. Next, the user presses the detergent container 11 down while pushing the push button 15 such that the hook 14 operated in conjunction with the push button 15 engages with the corresponding hook hole 5.

As such, where the conventional detergent supply device 10 is locked to or released from the cabinet 1, a user necessarily uses both of his/her hands, and a sufficient force must be applied to the detergent supply device 10 to engage or disengage the hooks 14 with or from the hook holes 5. Accordingly, it is very inconvenient and time consuming to lock or release the detergent supply device 10 to or from the cabinet 1.

In the case of installing a conventional detergent supply device 10 to a large-capacity washing machine, it is even more difficult to lock or release the detergent supply device 10 to or from a cabinet 1 thereof, making it impossible for a user of small stature, in some instances, to lock or release the detergent supply device 10 to or from the cabinet 1.

Additionally, in the conventional washing machine, the push button 15 and the two hooks 14, which are provided to lock or release the detergent supply device 10 to or from the cabinet 1, are installed on the lower portion of the detergent container 11. As such, the detergent container 11 of the detergent supply device 10 is inevitably and upwardly projected from the cabinet 1. Therefore, the appearance of the conventional washing machine is poor. The detergent container 11 containing the powdered detergent is also made of a crystalline resin which does not contain moisture. However, the detergent container 11 made of the crystalline resin is poor in color and surface treatment, and does not aesthetically match with the cabinet 1, which is made of a non-crystalline resin to provide a good appearance to the washing machine, thus further spoiling the appearance of the washing machine.

Furthermore, since the detergent container 11 of the detergent supply device 10 is upwardly projected from the cabinet 1 and exposed to the outside of the cabinet 1, water may splash into the detergent supply device 10. In this case, the water flows into the detergent container 11 through the detergent feeding unit 13, which downwardly extends from the lower end of the detergent container 11, and undesirably solidifies the powdered detergent. In such a case, the detergent does not smoothly feed into the washing tub 2, thereby lowering the reliability of the washing machine.

The conventional detergent supply device 10 is also designed to manually feed the powdered detergent into the washing tub 2 using gravity. Therefore, a detergent outlet port of the detergent supply device 10 may clog where the powdered detergent is solidified, making it more difficult to feed the powdered detergent into the washing tub 2.

SUMMARY OF THE INVENTION

Accordingly, it is an aspect of the present invention to provide a washing machine having a detergent supply device which is easily and removably installed to a cabinet of the washing machine.

Another aspect of the present invention is to provide a washing machine having a detergent supply device which is not exposed to the outside of a cabinet, thus providing a good appearance, and preventing powdered detergent therein from being solidified.

Yet another aspect of the present invention is to provide a washing machine having a detergent supply device which is provided with an automatic detergent feeding unit. The automatic detergent feeding unit automatically and effectively feeds detergent into a washing tub.

Additional aspects and advantages of the invention will be set forth in part in the description which follows and, in part, will be obvious from the description, or may be learned by practice of the invention.

To achieve the above and/or other aspects of the present invention, there is provided a washing machine comprising a cabinet which defines an appearance of the washing machine, a detergent supply device which is removably installed in the cabinet, and a reception chamber which is defined at an upper portion of the cabinet to receive the detergent supply device. The detergent supply device includes a detergent container to contain detergent therein, and a handle which is mounted on an upper portion of the detergent container and selectively locks and releases the detergent supply device to and from the reception chamber in response to the handle being rotated.

The reception chamber may have a depth corresponding to a height of the detergent supply device so as to have the detergent supply device not be projected from the cabinet where the detergent supply device is seated in the reception chamber.

The handle may include two side mounting parts which rotatably mount the handle to the detergent container and removably lock the handle to the cabinet, and a connection part which integrally connects the two side mounting parts to each other into a single structure.

The handle may include hinge holes which are provided on the corresponding side mounting parts, and the detergent container may include hinge shafts which are outwardly projected from an upper portion of corresponding opposite sidewalls of the detergent container, so as to be inserted into the respective hinge holes and rotatably mount the handle to the detergent container.

The handle may further include locking slots which are formed on the corresponding side mounting parts, at corresponding positions adjacent to the respective hinge holes, and are provided with an opening which is downwardly opened where the handle is upwardly rotated. The reception chamber may include locking projections which are provided on the corresponding opposite sidewalls of the reception chamber, and are inserted into the locking slots through the openings to lock the detergent supply device to the reception chamber in response to the detergent container being seated in the reception chamber and the handle being downwardly rotated.

The detergent container may have at least one sidewall thereof which is downwardly and inwardly inclined, so as to allow the detergent to easily flow to a bottom of the detergent container. The at least one sidewall of the detergent container may have an angle in a range from 45° to 55° with respect to a horizontal support surface of the detergent container.

The reception chamber may include a cover which is installed on an upper portion of the reception chamber to open and close the reception chamber, so as to cover the detergent supply device received in the reception chamber.

The cover may be hinged to a rear portion of the reception chamber so as to be rotated upward and downward.

The cover may include at least one hook which is provided on a front end of the cover, and the reception chamber may further include at least one hook hole which is formed on a front portion of the reception chamber to engage with the hook, so as to have the cover openably cover an open top portion of the reception chamber.

The detergent supply device may further include a detergent feeding part which is provided at a lower portion of the detergent container, and includes an automatic detergent feeding unit which automatically feeds the detergent to the washing machine.

The detergent feeding part may have a tubular shape and be open at first and second ends thereof. The automatic detergent feeding unit may include a feed screw which is set in the detergent feeding part and rotates to feed the detergent to the second end of the detergent feeding part, a detergent feeding motor which is provided at a position adjacent to the first end of the detergent feeding part and drives the feed screw, a cap which is provided at the second end of the detergent feeding part, and a cap drive motor which selectively opens and closes the cap.

BRIEF DESCRIPTION OF THE DRAWINGS

These and other aspects and advantages of the present invention will become apparent by describing in detail preferred embodiments thereof with references to the accompanying drawings in which:

FIGS. 2A and 2B show a detergent supply device of a washing machine according to an embodiment of the present invention, in which FIG. 2A is an exploded perspective view of the detergent supply device, and FIG. 2B is a perspective view of the detergent supply device;

FIGS. 6A and 6B are partial sectional views of the washing machine shown in FIG. 4 with the detergent supply device of FIGS. 2A and 2B installed in the cabinet, in which FIG. 6A shows the washing machine where the cover is open, and FIG. 6B shows the washing machine where the cover is closed.

DETAILED DESCRIPTION OF THE PREFERRED EMBODIMENTS

Figure 1:
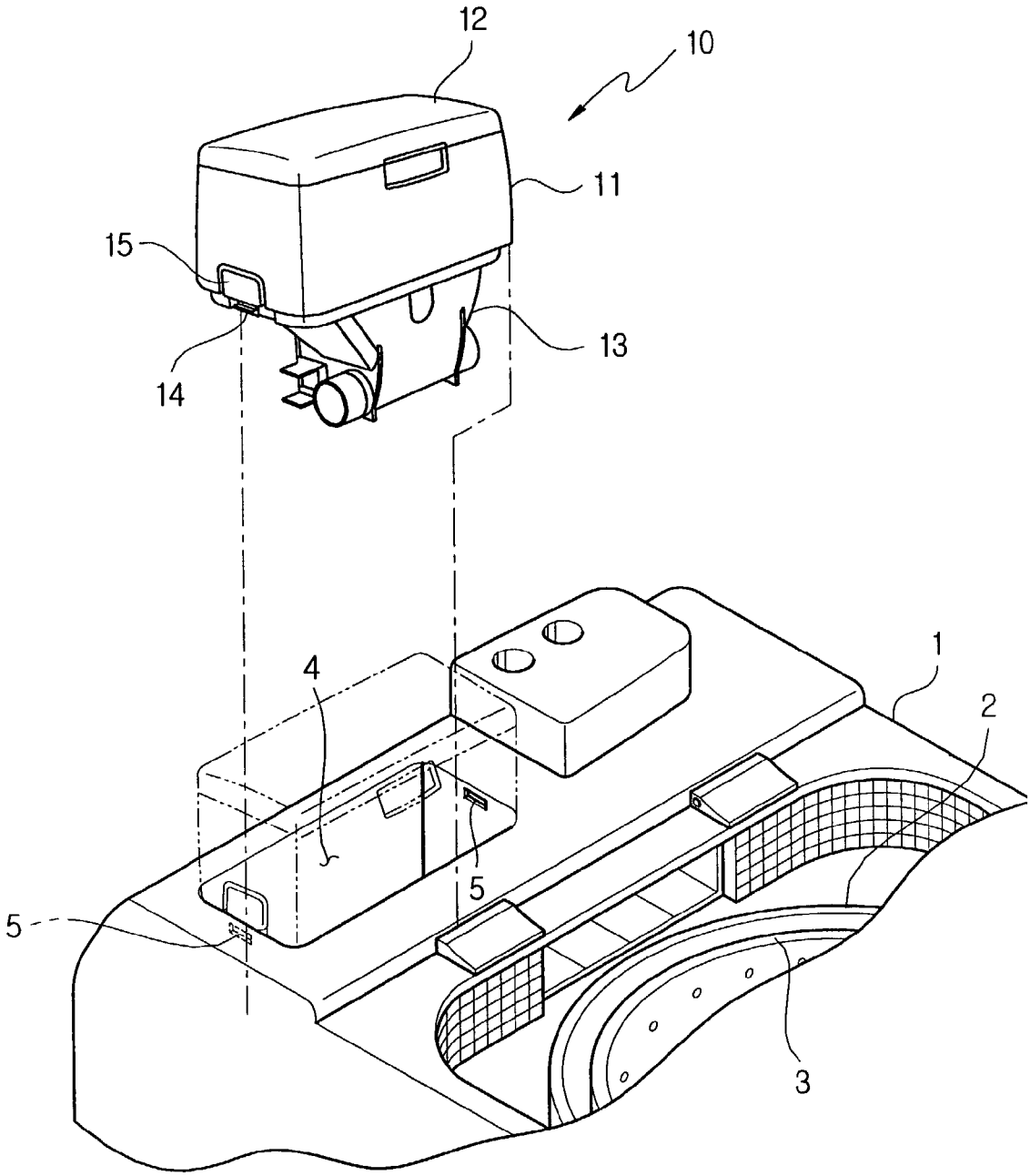
FIG. 1 (PRIOR ART)
FIG. 1 is a partial perspective view of a conventional washing machine having a conventional detergent supply device mounted on a cabinet.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Although a washing machine having a detergent supply device according to the present invention is described herein with reference to vertical shaft type washing machines, it is understood that the present invention can be applied to other types of washing machines, including drum type washing machines.

Figure 2A:
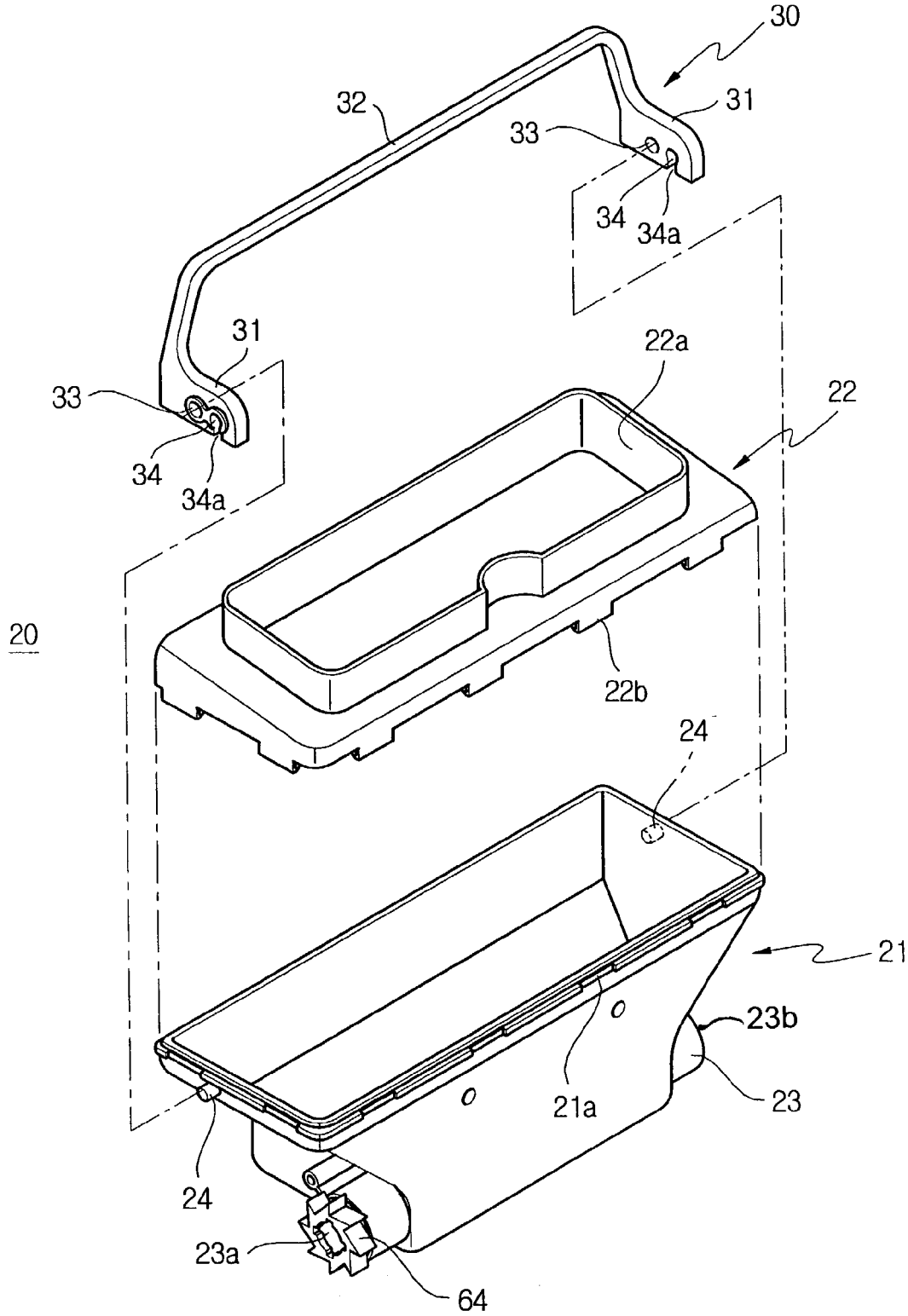
Figure 2B:
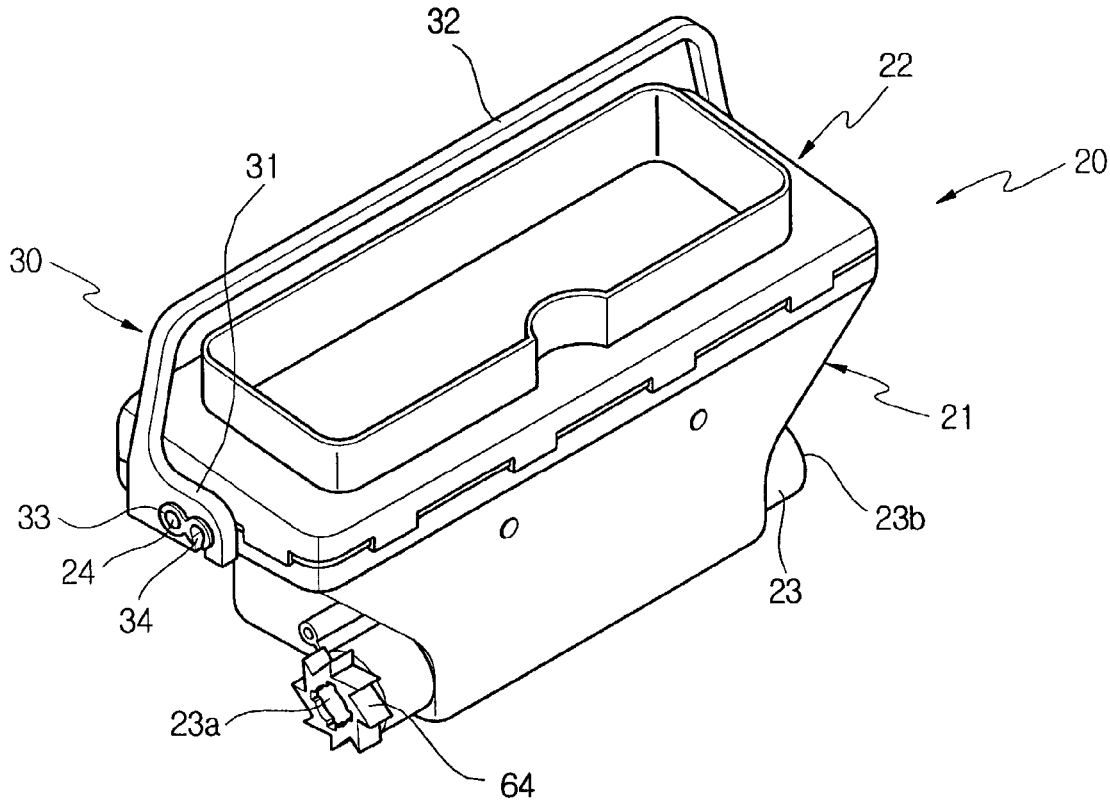
Figure 3:
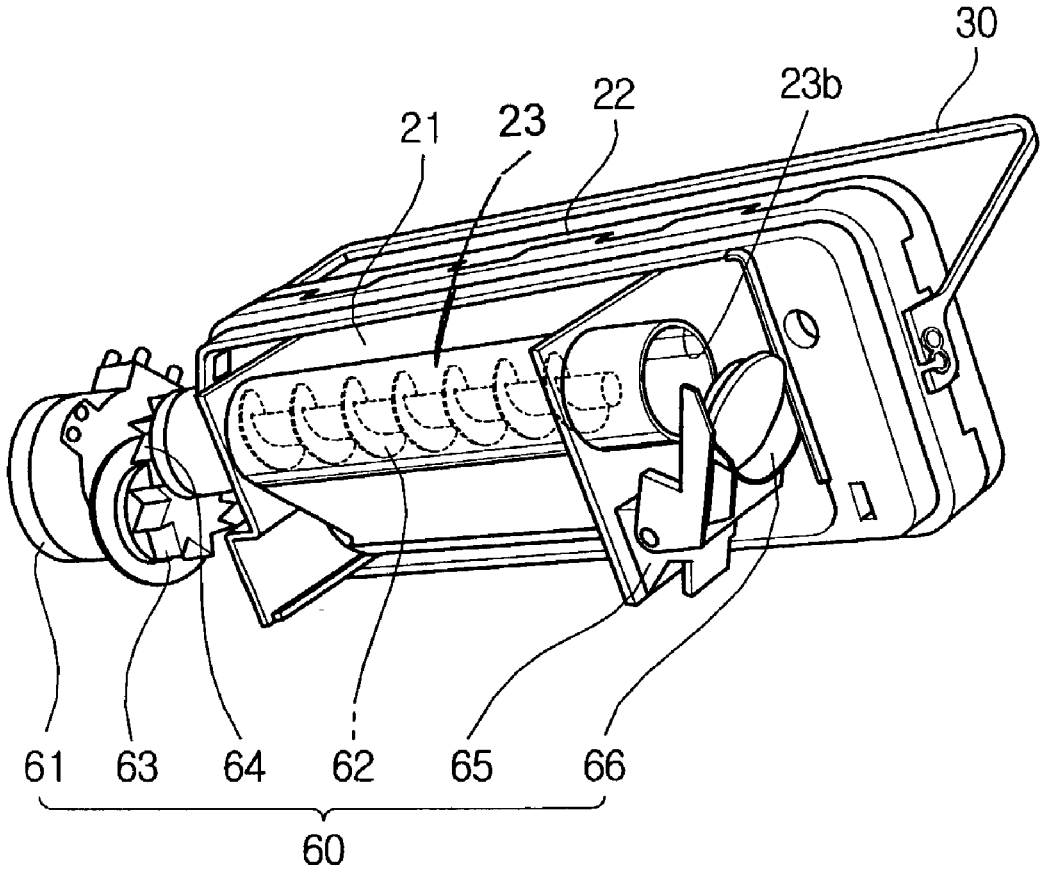
FIG. 3 is a bottom perspective view of the detergent supply device of the washing machine shown in FIGS. 2A and 2B, in which the detergent supply device is provided with an automatic detergent feeding unit to automatically feed powdered detergent into a washing tub of the washing machine.

FIGS. 2A and 2B show a detergent supply device 20 of a washing machine according to an embodiment of the present invention. FIG. 3 is a bottom perspective view of the detergent supply device 20 having an automatic detergent feeding unit 60 to automatically feed powdered detergent into a washing tub 2 (see FIG. 4) of the washing machine.

As shown in the drawings, the detergent supply device 20 of the present invention includes a detergent container 21, an upper member 22, and a handle 30. The detergent container 21 receives, for example, powdered detergent therein. The upper member 22 is mounted on an open top of the detergent container 21. The handle 30 is hinged to an upper portion of the detergent container 21 so as to lock or release the detergent container 21 to or from a cabinet 1 of the washing machine (see FIG. 4). A detergent feeding part 23 is provided at a lower portion of the detergent container 21. The automatic detergent feeding unit 60 is provided in the detergent feeding part 23 to automatically feed the powdered detergent from the detergent container 21 to the washing tub 2 (see FIG. 4).

Since sidewalls of the detergent container 21 are downwardly and inwardly inclined in such a way as to be tapered from a top to a bottom of the detergent container 21, the powdered detergent easily flows to the bottom of the detergent container 21 and converges into the detergent feeding part 23. The angles of the inclined sidewalls of the detergent container 21 may be from 45° to 55° with respect to a horizontal support surface of the detergent container 21.

The upper member 22 is opened at a top wall thereof to form a walled opening 22*a*, so as to place the powdered detergent into the detergent container 21 through the walled opening 22*a*. Several locking lugs 22*b*, spaced apart from each other, are provided along a lower edge of a skirt provided at a lower portion of the upper member 22. Locking notches 21*a* corresponding to the locking lugs 22*b* are formed along an upper edge of the detergent container 21, thus allowing the upper member 22 to be easily locked to or unlocked from the detergent container 21.

The handle 30 includes two side mounting parts 31 and a connection part 32. In this case, the side mounting parts 31 function to rotatably mount the handle 30 to the detergent container 21 and to removably lock the handle 30 to the cabinet 1. The connection part 32 integrally connects the two side mounting parts 31 to each other, and is handled to rotate the handle 30. The handle 30 is used to lock and release the detergent supply device 20 to and from the cabinet 1 (see FIG. 4).

A hinge hole 33 and a locking slot 34 are provided on each side mounting part 31 so as to be adjacent to each other. A hinge shaft 24 is provided at an upper portion of each of opposite sidewalls of the detergent container 21, and is inserted into the corresponding hinge hole 33 to allow the handle 30 to be rotated upward or downward with respect to the detergent container 21. The handle 30 is made of, for example, an elastic material so as to have the side mounting parts 31 easily and elastically stretched out where the hinge shafts 24 are inserted into the hinge holes 33.

Each locking slot 34 is provided with an opening 34*a* which is downwardly opened where the handle 30 is upwardly rotated to be positioned above the detergent container 21. Thus, as the handle 30 is downwardly rotated, locking projections 41 (see FIG. 4) of a reception chamber 40, which will be described later herein, are inserted into the locking slots 34 through the openings 34*a*.

The detergent feeding part 23 has, for example, a tubular shape, and has first and second ends 23*a* and 23*b* which are opened at left and right side ends of the detergent feeding part 23, respectively.

Referring to FIG. 3, the automatic detergent feeding unit 60 includes a detergent feeding motor 61 and a cap drive motor 65. The detergent feeding motor 61 is provided at a position adjacent to the open first end 23*a* (see FIG. 2A) of the detergent feeding part 23, and the cap drive motor 65 is provided at a position adjacent to the open second end 23*b* of the detergent feeding part 23. In this case, the detergent feeding motor 61 and the cap drive motor 65 are fixedly installed in the cabinet 1. Thus, although the detergent container 21 is removed from the cabinet 1, the detergent feeding motor 61 and the cap drive motor 65 are maintained in the cabinet 1.

Figure 4:
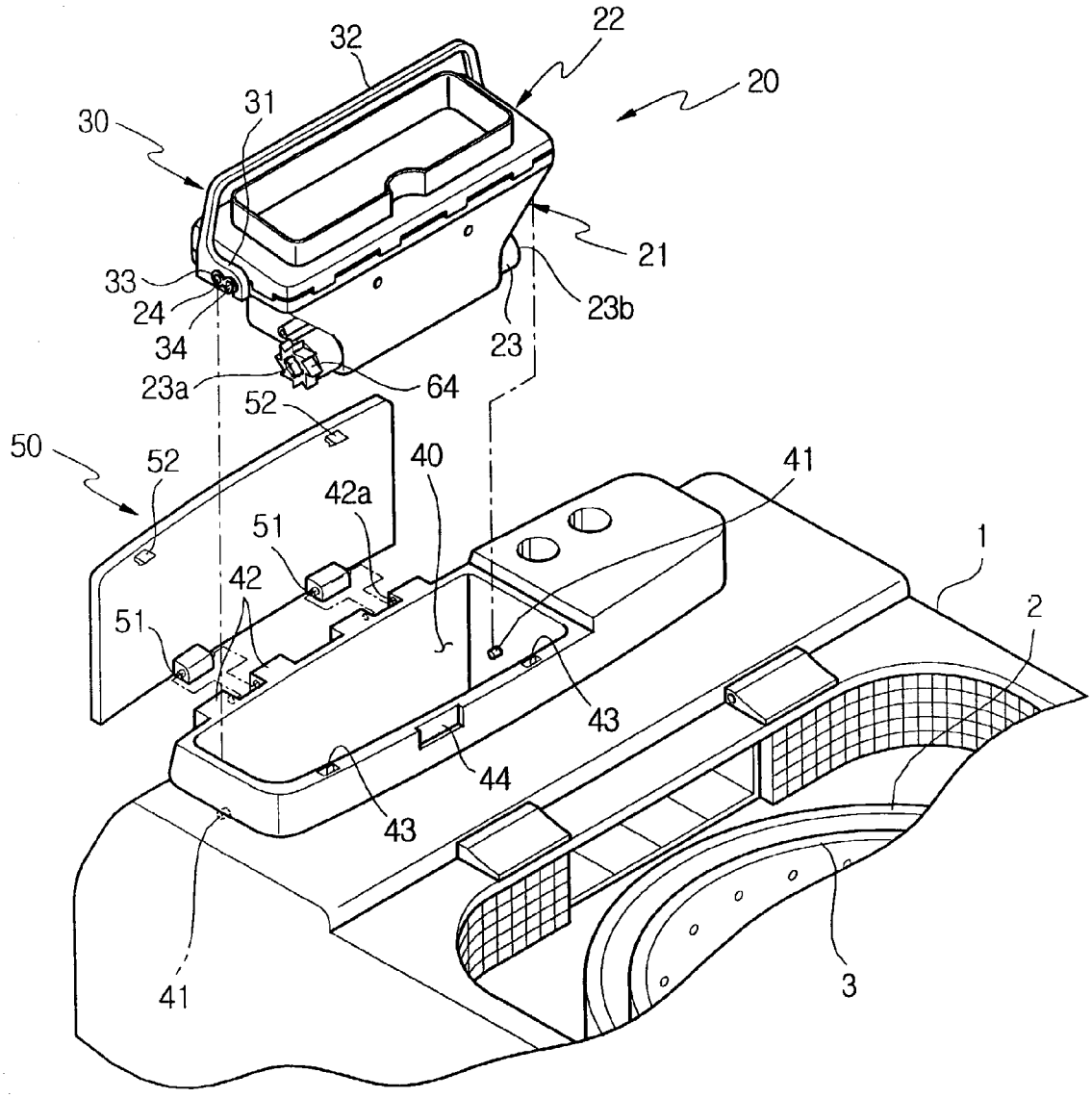
FIG. 4 is a partial perspective view of a washing machine according to the present invention, where the detergent supply device shown in FIGS. 2A and 2B is removed from a cabinet having a cover which functions to cover an open top of the detergent supply device.

The second end 23*b* of the detergent feeding part 23 serves as an outlet port to supply the powdered detergent to the washing tub 2 (see FIG. 4). The second end 23*b* is covered with a cap 66 which is connected to the cap drive motor 65. Thus, where the cap drive motor 65 is operated, the cap 66 is pulled to open the second end 23*b*. On the contrary, where the cap drive motor 65 stops operating, the cap 66 is elastically returned to its original position while closing the second end 23*b*.

A feed screw 62 is set in the detergent feeding part 23, and is rotated by the detergent feeding motor 61 to discharge the powdered detergent through the second end 23*b*. To removably connect the feed screw 62 to the detergent feeding motor 61, a first coupling gear 63 is mounted to the detergent feeding motor 61 and a second coupling gear 64 is mounted at an end of the feed screw 62 outside the first end 23*a* of the detergent feeding part 23. The first coupling gear 63 connected to the detergent feeding motor 61 engages with the second coupling gear 64 connected to the feed screw 62. Thus, where the detergent container 21 is lifted up, the second coupling gear 64 disengages from the first coupling gear 63. Meanwhile, where the detergent container 21 is pushed into the reception chamber 40 (see FIG. 4), the second coupling gear 64 engages with the first coupling gear 63 to connect the feed screw 62 to the detergent feeding motor 61.

As described above, the cap 66 is provided at the second end 23*b* of the detergent feeding part 23, and selectively opens or closes the second end 23*b* by an operation of the cap drive motor 65. Where the detergent feeding motor 61 and the cap drive motor 65 are not operated, the cap 66 closes the second end 23*b* so as to prevent the powdered detergent from being discharged through the second end 23*b*. On the other hand, where the detergent feeding motor 61 and the cap drive motor 65 are operated, the cap 66 is pulled by the cap drive motor 65 to open the second end 23*b*, thus supplying the powdered detergent fed by the rotation of the feed screw 62 to the washing tub 2 (see FIG. 4).

Figure 5:
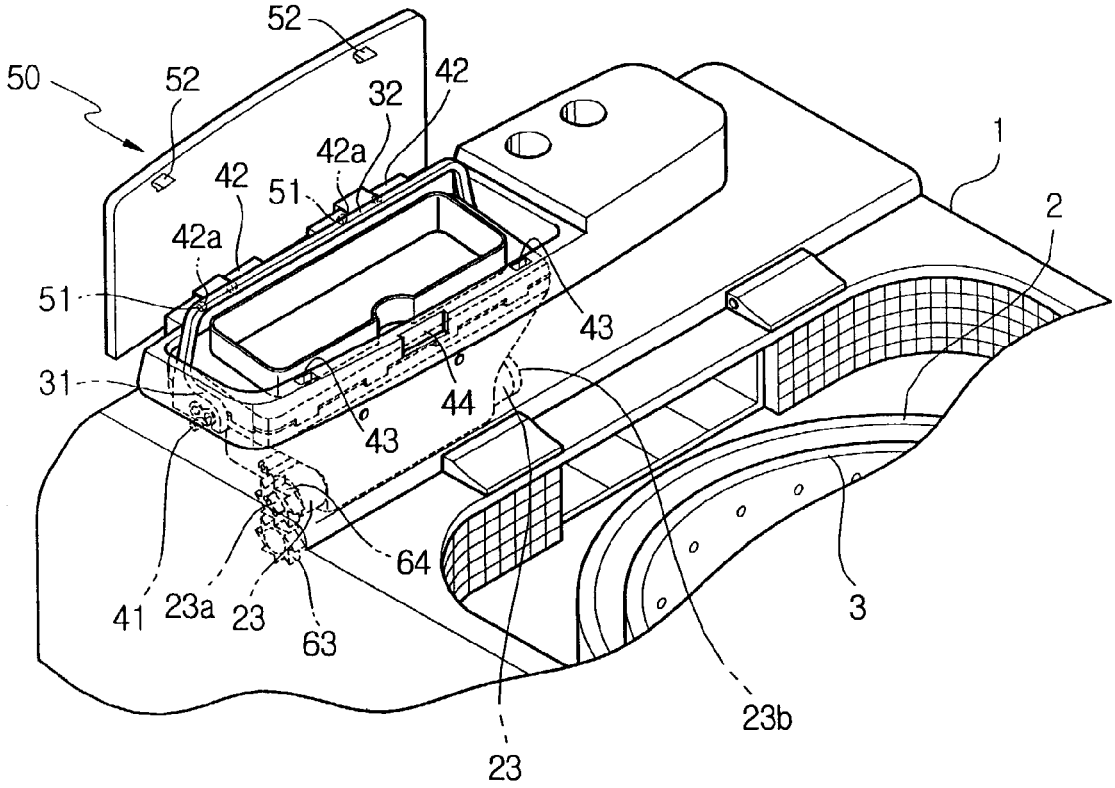
FIG. 5 is a partial perspective view of the washing machine shown in FIG. 4, where the cover is open and the detergent supply device of FIGS. 2A and 2B is inserted into the cabinet.

FIG. 4 shows a part of a washing machine according to the present invention, where the detergent supply device 20 is released from the cabinet 1 having a cover 50 which functions to cover the detergent supply device 20. FIG. 5 shows the part of the washing machine shown in FIG. 4, where the cover 50 is open and the detergent supply device 20 is seated in the cabinet 1.

As shown in the drawings, the reception chamber 40 is defined at a rear position on an upper portion of the cabinet 1 so as to seat the detergent supply device 20 in the cabinet 1 of the washing machine. The reception chamber 40 has a depth which allows the detergent supply device 20 to be completely received in the reception chamber 40. The locking projections 41 are provided on opposite sidewalls of the reception chamber 40, and are inserted into the locking slots 34 which are provided on the handle 30 of the detergent supply device 20.

The cover 50, which functions to open and close an open top portion of the reception chamber 40, is installed on the cabinet 1 to cover the detergent supply device 20, which is seated in the reception chamber 40. The cover 50 prevents the detergent supply device 20 from being exposed to the outside. Several hinge shafts 51 are provided on a rear end of the cover 50. Several hinge members 42 are provided on a rear portion of the reception chamber 40, and are provided with several hinge holes 42*a* so as to rotatably fit the hinge shafts 51 into the hinge holes 42*a*. Thus, the cover 50 is rotatably hinged to the cabinet 1 by inserting the hinge shafts 51 into the hinge holes 42*a* of the hinge members 42. In this case, each hinge member 42 may be elastically deformed in a horizontal direction, thus allowing the hinge shafts 51 of the cover 50 to be easily inserted into the hinge holes 42*a* of the hinge members 42.

Several hooks 52 are provided on a front end of the cover 50, and several hook holes 43 are formed on a front portion of the reception chamber 40 to engage with the hooks 52, so as to maintain the cover 50 in an openable closed position on the upper portion of the reception chamber 40. Each hook 52 is designed such that its free end is elastically deformed back and forth. A depression 44 is formed at a center of the front portion of the reception chamber 40 to allow the cover 50 to be easily opened.

In response to pressing the cover 50 down, the hooks 52 provided on the cover 50 engage with the hook holes 43 provided on the reception chamber 40. In response to opening the cover 50 using the depression 44, the hooks 52 are disengaged from the hook holes 43. At this time, the cover 50 is upwardly moved with respect to the hinge shafts 51 to be opened.

The cover 50 may be made of a non-crystalline resin, which is the same material of the cabinet 1, and may have the same color of the cabinet 1, thereby maintaining a good uniform appearance of the washing machine. Meanwhile, since the detergent supply device 20 is covered with the cover 50 and not exposed to the outside, where the detergent supply device 20 is seated in the reception chamber 40 of the cabinet 1, the detergent supply device 20 may be made of a crystalline resin. Although, the crystalline resin does not provide a good appearance as compared to the non-crystalline resin, the crystalline resin does not contain moisture and prevents the powdered detergent from being solidified.

An operation of locking and releasing the detergent supply device 20 to and from the reception chamber 40 of the cabinet 1 will be described with reference to FIGS. 6A and 6B.

Figure 6A:
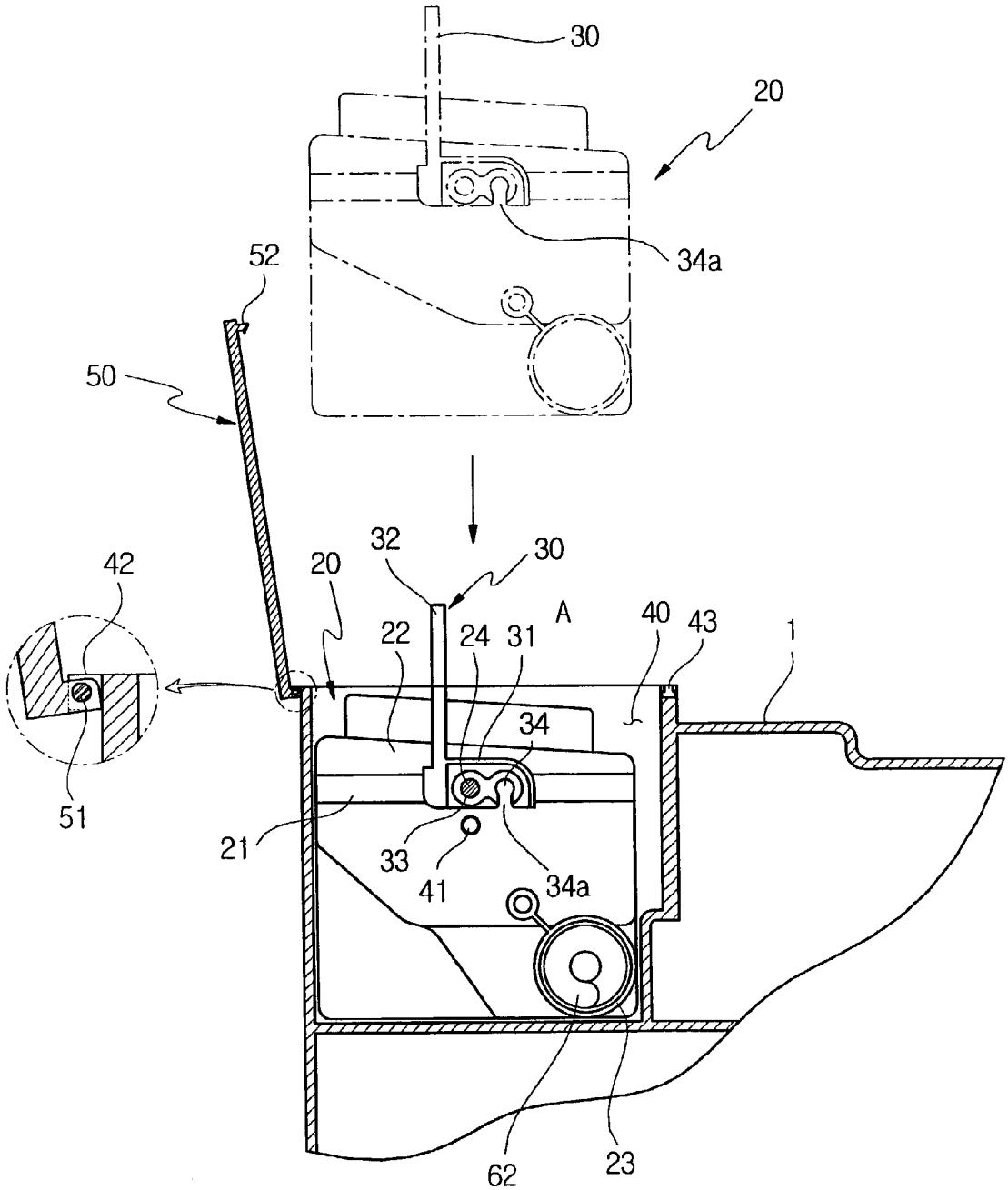
Figure 6B:
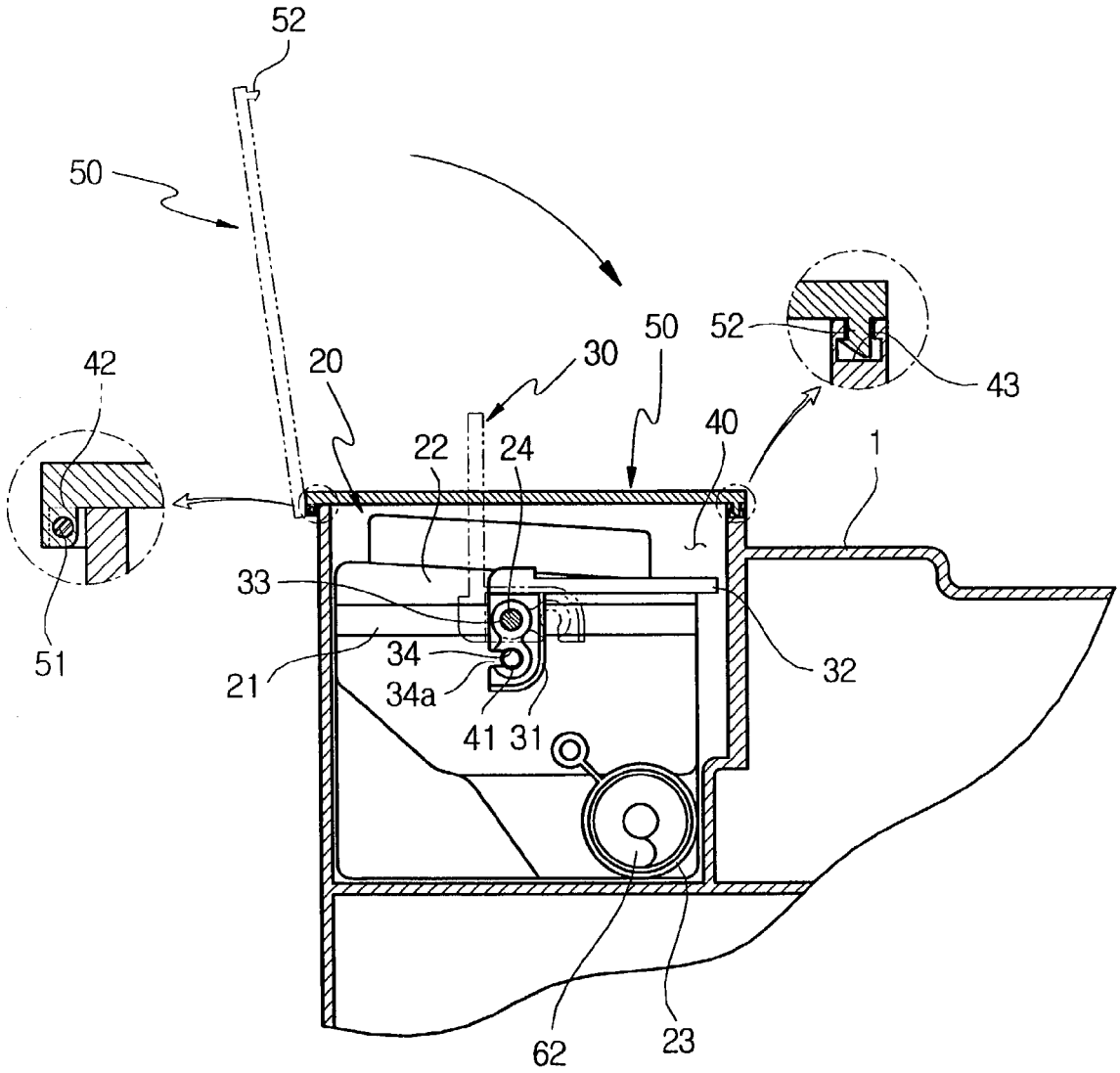

FIGS. 6A and 6B show partial sectional views of the washing machine according to the present invention, with the detergent supply device 20 installed in the cabinet 1, in which FIG. 6A shows the washing machine where the cover 50 is open, and FIG. 6B shows the washing machine where the cover 50 is closed.

As shown in FIG. 6A, where the cover 50 is open, a user may hold the handle 30 upwardly positioned, and downwardly move the detergent supply device 20 from a position above the cabinet 1 to insert the detergent supply device 20 into the reception chamber 40. Thereafter, where the handle 30 is downwardly rotated, the locking projections 41 provided on the opposite sidewalls of the reception chamber 40 are inserted into the locking slots 34 of the handle 30, as shown in FIG. 6B. Next, the cover 50 is downwardly rotated with respect to the hinge shafts 51 to press the front end of the cover 50. At this time, the hooks 52 of the cover 50 engage with the hook holes 43 of the reception chamber 40, so as to have the cover 50 cover the upper portion of the reception chamber 40 and close the reception chamber 40.

As described above, the open top portion of the reception chamber 40 is covered with the cover 50 such that the detergent supply device 20 is not exposed to the outside, thus preventing water from splashing into the detergent supply device 20, and providing a good appearance to the washing machine.

Where the detergent supply device 20 is seated in the reception chamber 40 and the handle 30 is upwardly rotated, as shown in FIG. 6A, the locking projections 41 of the reception chamber 40 is not inserted into the locking slots 34 of the handle 30. Accordingly, the detergent supply device 20 is not locked to the reception chamber 40. As such, with the handle 30 upwardly rotated, the cover 50 is not closed.

That is, since the cover 50 is closed only where the handle 30 is downwardly rotated and the locking projections 41 of the reception chamber 40 are inserted into the locking slots 34, a user may automatically confirm that the detergent supply device 20 is locked to the cabinet 1 inside the reception chamber 40 where the cover 50 is closed.

Referring to FIG. 6B, to take the detergent supply device 20 out of the reception chamber 40, i.e., to replenish the powdered detergent, the cover 50 is primarily opened using the depression 44 (see FIG. 4), which is formed at the center of the front portion of the reception chamber 40. At this time, the hooks 52 disengage from the hook holes 43, thus opening the cover 50. Where the handle 30 of the detergent supply device 20 is upwardly rotated in such a state, the detergent supply device 20 is released from the reception chamber 40 of the cabinet 1. Next, where a user lifts up the handle 30, the detergent supply device 20 is easily taken out of the reception chamber 40. Where the detergent supply device 20 is taken out of the reception chamber 40 as such, the detergent feeding motor 61, the first coupling gear 63, the cap drive motor 65 and the cap 66 of the automatic detergent feeding unit 60 are left at their respective positions in the reception chamber 40, whereas the feed screw 62 received in the detergent feeding part 23 and the second coupling gear 64 are separated from the other parts of the automatic detergent feeding unit 60, and are removed from the reception chamber 40 along with the detergent supply device 20.

As described above, the present invention provides a washing machine having a detergent supply device which is easily locked to and released from a cabinet of the washing machine, by rotating a handle mounted on an upper portion of a detergent container of the detergent supply device. Accordingly, a user can easily lock and release the detergent supply device to and from the cabinet.

Additionally, the detergent supply device is seated in a reception chamber provided on an upper portion of the cabinet so as not to project upwardly from the cabinet. A rotatable cover is also provided to open and close an open top portion of the reception chamber, so as not to expose the detergent supply device to the outside where the cover closes the open top portion. The above-described features provide a good uniform appearance to the washing machine, and prevent water from splashing into the detergent supply device and solidifying powdered detergent therein.

Furthermore, the detergent supply device is made of a non-crystalline resin, which further prevents the powdered detergent from being solidified.

The detergent supply device also automatically feeds the powdered detergent into a washing tub of the washing machine, thus smoothly and effectively feeding the powdered detergent into the washing tub, even though the powered detergent may be solidified by exposure to moisture or water.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A washing machine having a wash tub to receive laundry therein, the washing machine comprising:

a cabinet which defines an appearance of the washing machine;

a detergent supply device which is removably installed in the cabinet; and a reception chamber which is defined at an upper portion of the cabinet to receive the detergent supply device, wherein the detergent supply device comprises:

a detergent container to contain detergent therein, and a handle comprising a pair of side mounting parts and a connection part connecting the pair of side mounting parts to each other, to rotatably mount the handle to an upper portion of the detergent container, and the handle selectively locking and releasing the detergent supply device to and from the reception chamber in response to the handle being rotated downwardly and upwardly, respectively.

2. The washing machine as set forth in claim 1, wherein the reception chamber has a depth corresponding to a height of the detergent supply device so as to have the detergent supply device not be projected from the cabinet where the detergent supply device is seated in the reception chamber.

3. A washing machine having a washing tub, the washing machine comprising:

a cabinet which defines an appearance of the washing machine;

a detergent supply device which is removably installed in the cabinet; and a reception chamber which is defined at an upper portion of the cabinet to receive the detergent supply device, wherein the detergent supply device comprises:

a detergent container to contain detergent therein, and a handle which is mounted on an upper portion of the detergent container, and selectively locks and releases the detergent supply device to and from the reception chamber in response to the handle being rotated, wherein the handle comprises:

two side mounting parts which rotatably mount the handle to the detergent container and removably lock the handle to the cabinet; and a connection part which integrally connects the two side mounting parts to each other into a single structure.

4. The washing machine as set forth in claim 3, wherein:

the handle includes hinge holes which are provided on the corresponding side mounting parts, and the detergent container includes hinge shafts which are outwardly projected from an upper portion of corresponding opposite sidewalls of the detergent container, so as to be inserted into the respective hinge holes and rotatably mount the handle to the detergent container.

5. The washing machine as set forth in claim 4, wherein:

the handle further includes locking slots which are formed on the corresponding side mounting parts, at corresponding positions adjacent to the respective hinge holes, and are provided with an opening which is downwardly opened where the handle is upwardly rotated, and the reception chamber includes locking projections which are provided on the corresponding opposite sidewalls of the reception chamber, and are inserted into the locking slots through the openings to lock the detergent supply device to the reception chamber in response to the detergent container being seated in the reception chamber and the handle being downwardly rotated.

6. The washing machine as set forth in claim 1, wherein the detergent container has at least one sidewall thereof which is downwardly and inwardly inclined, so as to allow the detergent to easily flow to a bottom of the detergent container.

7. The washing machine as set forth in claim 6, wherein the at least one sidewall of the detergent container has an angle in a range from 45° to 55° with respect to a horizontal support surface of the detergent container.

8. The washing machine as set forth in claim 1, wherein the reception chamber includes a cover which is installed on an upper portion of the reception chamber to open and close the reception chamber, so as to cover the detergent supply device received in the reception chamber.

9. The washing machine as set forth in claim 8, wherein the cover is hinged to a rear portion of the reception chamber so as to be rotated upward and downward.

10. The washing machine as set forth in claim 8, wherein the cover comprises the same material and has the same color as those of the cabinet.

11. The washing machine as set forth in claim 1, wherein the detergent supply device further comprises a detergent feeding part which is provided at a lower portion of the detergent container, and includes an automatic detergent feeding unit which automatically feeds the detergent to the washing machine.

12. The washing machine as set forth in claim 11, wherein:

the detergent feeding part has a tubular shape and is open at first and second ends thereof, and the automatic detergent feeding unit comprises:

a feed screw which is set in the detergent feeding part and rotates to feed the detergent to the second end of the detergent feeding part;

a detergent feeding motor which is provided at a position adjacent to the first end of the detergent feeding part and drives the feed screw;

a cap which is provided at the second end of the detergent feeding part; and a cap drive motor which selectively opens and closes the cap.

13. The washing machine as set forth in claim 12, wherein:

the cap is connected to the cap drive motor and biased to normally close the second end of the detergent feeding part, and the detergent feeding motor and the cap driving motor are fixedly installed in the cabinet and do not disengage the cabinet in response to removal of the detergent supply device from the cabinet.

14. The washing machine as set forth in claim 1, wherein the detergent supply device is made of a crystalline resin material which prevents the detergent from solidifying.

15. The washing machine as set forth in claim 1, wherein the detergent supply device further comprises an upper member having an opening and removably mounted on an open top of the detergent container.

16. A washing machine having a washing tub, the washing machine comprising:

a cabinet which defines an appearance of the washing machine;

a detergent supply device which is removably installed in the cabinet; and a reception chamber which is defined at an upper portion of the cabinet to receive the detergent supply device, wherein the detergent supply device comprises:

a detergent container to contain detergent therein, and a handle comprising a pair of side mounting parts and a connection part connecting the side mounting parts to each other, to rotatably mount the handle to an upper portion of the detergent container, and the handle selectively locking and releasing the detergent supply device to and from the reception chamber in response to the handle being rotated, wherein the reception chamber includes a cover which is installed on an upper portion of the reception chamber to open and close the reception chamber, so as to cover the detergent supply device received in the reception chamber, and the cover is hinged to a rear portion of the reception chamber so as to be rotated upward and downward, wherein:

the cover includes at least one hook which is provided on a front end of the cover, and the reception chamber further includes at least one hook hole which is formed on a front portion of the reception chamber to engage with the hook, so as to have the cover openably cover an open top portion of the reception chamber.

17. A washing machine comprising:

a cabinet which defines an appearance of the washing machine;

a wash tub to receive laundry therein; and a detergent supply device which is removably installed in the cabinet, and comprises:

a detergent container to contain detergent therein, and a handle comprising a pair of side mounting parts and a connection part connecting the pair of side mounting parts to each other, to rotatably mount the handle to an upper portion of the detergent container, and the handle selectively locking and releasing the detergent supply device to and from the cabinet in response to the handle being rotated downwardly and upwardly, respectively.

18. The washing machine as set forth in claim 17, wherein the detergent supply device is installed within the cabinet so as not to be exposed to the outside of the cabinet.

19. The washing machine as set forth in claim 17, wherein the detergent supply device further comprises an automatic detergent feeding unit which aerates and automatically feeds the detergent to the wash tub.

20. A washing machine comprising:

a cabinet which defines an appearance of the washing machine;

a wash tub to receive laundry therein;

an automatic detergent supply device which is removably installed within the cabinet, and automatically feeds detergent received therein to the wash tub; and a handle comprising a pair of side mounting parts and a connection part connecting the pair of side mounting parts, to rotatably mount the handle to an upper portion of the detergent container, and the handle selectively locking and releasing the detergent supply device to and from the cabinet in response to the handle being rotated downwardly and upwardly, respectively.

21. A detergent supply device for use in a washing machine having a cabinet which defines an appearance of the washing machine, a wash tub to receive laundry therein, and a reception chamber which is defined in the cabinet to receive the detergent supply device therein, comprising:

a detergent container to contain detergent therein, and a handle comprising a pair of side mounting parts and a connecting part connecting the side mounting parts to each other, to rotatably mount the handle to an upper portion of the detergent container, and selectively locking and releasing the detergent supply device to and from the cabinet in response to the handle being rotated downwardly and upwardly, respectively.

22. The detergent supply device for use in a washing machine as set forth in claim 21, wherein the detergent supply device is installed within the reception chamber of the cabinet so as not to be exposed to the outside of the cabinet.

23. The detergent supply device for use in a washing machine as set forth in claim 21, wherein the detergent supply device further comprises an automatic detergent feeding unit which aerates and automatically feeds the detergent to the wash tub.

* * * * *